United States Patent [19]

Bisping et al.

[11] Patent Number: 4,982,669

[45] Date of Patent: Jan. 8, 1991

[54] SUBCALIBER DISCARDING SABOT PROJECTILE

[75] Inventors: Bernhard Bisping, Ratingen; Michael Vagedes; Siegfried Kessler, both of Düsseldorf, all of Fed. Rep. of Germany

[73] Assignee: Rheinmetall GmbH, Fed. Rep. of Germany

[21] Appl. No.: 314,692

[22] Filed: Feb. 3, 1989

[30] Foreign Application Priority Data

Feb. 4, 1988 [DE] Fed. Rep. of Germany ..... 3803231

[51] Int. Cl.[5] ..... E42B 14/06

[52] U.S. Cl. ..... 102/520; 102/522; 102/523

[58] Field of Search ..... 102/520–523

[56] References Cited

U.S. PATENT DOCUMENTS

| | | | |
|---|---|---|---|
| 3,741,900 | 2/1973 | Feldmann . | |
| 3,771,458 | 11/1973 | Schweimler et al. | 102/523 |
| 3,837,057 | 9/1974 | Engel . | |
| 3,951,071 | 4/1976 | Germershausen . | |
| 4,000,698 | 1/1977 | Corney . | |
| 4,437,409 | 3/1984 | Freymond . | |
| 4,505,204 | 3/1985 | Wikstrom | 102/523 |
| 4,709,638 | 12/1987 | Braden et al. | 102/522 |
| 4,735,148 | 4/1988 | Haltzman | 102/522 |

FOREIGN PATENT DOCUMENTS

| | | |
|---|---|---|
| 0051375 | 5/1982 | European Pat. Off. . |
| 0275685 | 7/1988 | European Pat. Off. . |
| 2238137 | 7/1974 | France . |

*Primary Examiner*—Charles T. Jordan
*Assistant Examiner*—Rochelle Lieberman
*Attorney, Agent, or Firm*—Spencer & Frank

[57] ABSTRACT

A subcaliber, spin stabilized, discarding sabot projectile of the type including a projectile body, with a conically tapered tip, and a discardable sabot which completely encloses said projectile body and includes a base portion and a plastic hood portion connected to the base portion, and with the hood portion having an inner conical surface which contacts at least a portion of the conically tapered tip of the projectile body and being provided, on its circumferential surface, with a plurality of symmetrically disposed grooves which extend in the longitudinal direction of said projectile and form desired break locations along which the hood portion tears open into a plurality of segments after firing from a weapon and after the projectile has left the weapon muzzle. The plastic material of the hood portion of the sabot in the bottom of each of the longitudinal grooves, at least in the region of the conically tapered projectile tip, has such a small wall thickness that a given crack formation is already initiated when the discarding sabot projectile is introduced, in rapid succession, into a cartridge chamber of a weapon to cause the material to be slightly separated at the desired break locations.

12 Claims, 1 Drawing Sheet

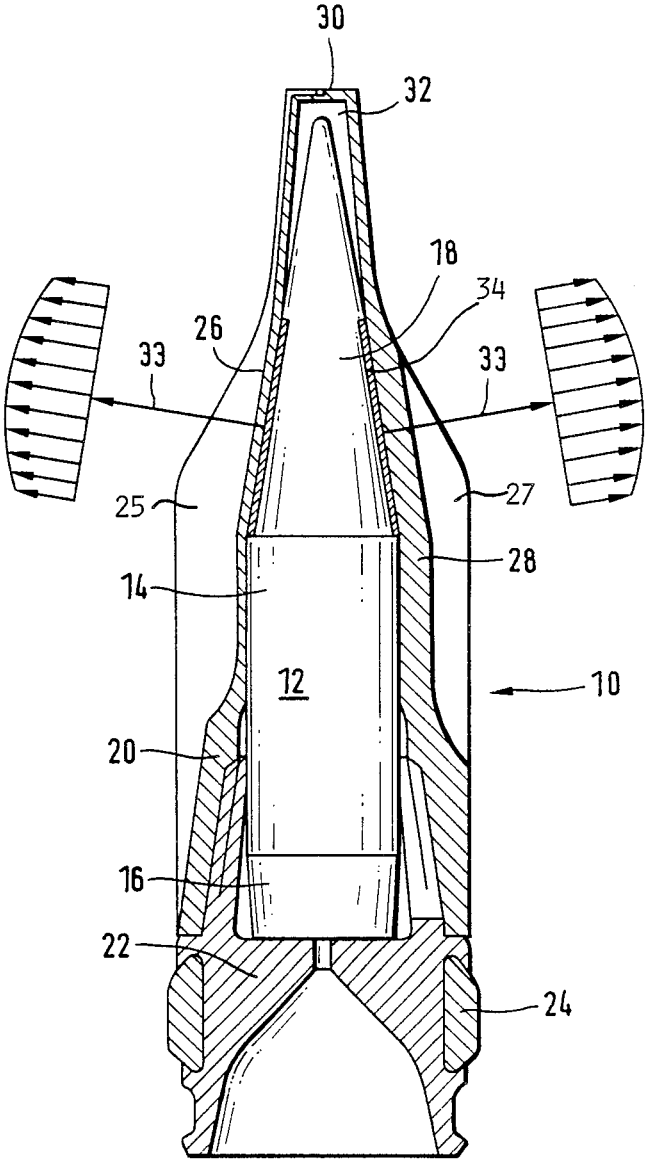
30
32
18
34
26
33
33
25
27
28
14
12
10
20
16
22
24

SUBCALIBER DISCARDING SABOT PROJECTILE

BACKGROUND OF THE INVENTION

The present invention relates to a subcaliber discarding sabot projectile. More particularly the present invention relates to subcaliber, spin stabilized, discarding sabot projectile in which the discardable sabot, which completely encloses the projectile body, includes a base portion and a hood portion connected to the base portion, and with the hood portion being provided with a plurality of grooves as desired break locations which extend in the longitudinal direction of the projectile on the circumferential surface of the hood portion and along which the propelling cage tears open after firing and after the projectile has left the gun muzzle, with the projectile body initiating the release process for the individual propelling cage segments.

Such a discarding sabot projectile is disclosed, for example, in FIG. 1 of published European patent application No. 0,051,375 A2, published May 12th, 1982. In such a discarding sabot projectile arrangement, the weight of the discarding sabot should be as low as possible and the ammunition should have a high hit probability while having the lowest possible manufacturing price.

In the disclosed discarding sabot projectile, when the discarding sabot segments are released from the projectile body after leaving the gun muzzle, the centrifugal forces occurring at the tip of the discarding sabot hood are only slight due to the tip being in the vicinity of the longitudinal axis of the projectile (spin axis), and consequently the release of the propelling cage segments, i.e. the hood segments, begins at the tail of the projectile body. Thus the process of releasing the propelling cage segments from the projectile body occurs relatively slowly. The propelling cage segments, which are still connected in the center at the front or tip of the sabot hood, are decelerated considerably and interfere with the free flight of the subcaliber projectile until the propelling cage segments have also torn apart at the tip of the hood. This causes the development of relatively strong interfering influences, resulting in pendulum effects on the projectile body, oblique landings (oblique hits in the target) and great hitting inaccuracies.

SUMMARY OF THE INVENTION

It is an object of the present invention to improve the behavior of the propelling cage segments when they are released from the projectile body, in particular, to make the release substantially uniform and symmetrical and thus, by avoiding interfering influences, increase the performance and hit accuracy of the projectile in the target.

The above object is generally achieved according to the present invention by a subcaliber, spin stabilized, discarding sabot projectile of the type including a projectile body, with a conically tapered tip, and a discardable sabot which completely encloses said projectile body and includes a base portion and a plastic hood portion connected to the base portion, and with the hood portion having an inner conical surface which contacts at least a portion of the conically tapered tip of the projectile body and being provided, on its circumferential surface, with a plurality of symmetrically disposed grooves which extend in the longitudinal direction of the projectile and form desired break locations along which the hood portion tears open into a plurality of segments after firing from a weapon and after the projectile has left the weapon muzzle; wherein the plastic material of the hood portion in the bottom of each of the longitudinal grooves, at least in the region of the conically tapered projectile tip, has such a small wall thickness that a given crack formation is already initiated when the discarding sabot projectile is introduced, in rapid succession, into a cartridge chamber of a weapon to cause the material to be slightly separated at the desired break locations.

With a discarding sabot projectile according to the invention, the loading stress produced by the ammunition (e.g. of 25, 35 or 40 mm caliber) which is loaded into the cartridge chamber of the weapon in rapid succession (e.g., 400 to 600 rounds per minute) causes all desired break locations (e.g., 4, in a propelling cage or sabot composed of four segments) in the forward region or hood of the propelling cage sabot and in the region of the conically tapered projectile body, to at least partially tear open while still in the cartridge chamber, and to thus separate the propelling cage into wedge-like segments.

The present invention further reduces the weight of the propelling cage and manufacturing costs are low. The acceleration in the barrel upon firing produces a gas column in front of the discarding sabot projectile which generates a counter pressure on the foremost, flat tip of the propelling cage hood, causing the crack formation initiated during loading to progress and the desired break locations to tear further open toward the front so that a uniform, symmetrical and simultaneous release of the propelling cage segments takes place immediately after the projectile leaves the muzzle and does not interfere with the subcaliber projectile body. The individual propelling cage segments are released almost simultaneously at the front and back, i.e. almost parallel to the longitudinal axis of the projectile. In contrast to the above identified known arrangement, the release process is initiated at the tip of the propelling cage hood, since this is the part which leaves the muzzle first.

BRIEF DESCRIPTION OF THE DRAWINGS

The FIGURE is a longitudinal sectional view of a subcaliber discarding sabot projectile according to the invention with the section being along two non-aligned radii, i.e. an angle other than 180° is formed at the center axis.

DETAILED DESCRIPTION OF THE PREFERRED EMBODIMENT

Referring now to the FIGURE, there is shown a subcaliber discarding sabot projectile 10 which includes a projectile body 12 which is completely enclosed in a propelling cage sabot. The projectile body 12 has a cylindrical center section 14, a slightly conical tail section 16 and a conically tapered tip section 18, while the propelling cage sabot, which completely encloses the projectile body 12, includes a forward hood or propelling cage portion 20 and a rearward gas-receiving, spin-imparting bottom 22 which is releasably connected to the propelling cage or hood portion 20. The hood portion 20 is preferably formed of a plastic material while the bottom portion 22 is composed, for example, of an aluminum alloy, and is provided with a circumferential rotating and sealing band 24.

The hood or propelling cage portion 20 of the sabot is provided on its circumferential surface with a plurality of symmetrically disposed longitudinally extending grooves 25 which determine predetermined or desired break locations for the portion 20 of the sabot to divide same into a plurality of segments. As shown, the grooves 25 preferably extend over substantially the entire length of the hood portion 20. In the illustrated embodiment the hood portion 20 is provided with a further plurality of longitudinally extending grooves 27, which are symmetrically disposed between the grooves 25, and which serve simply to reduce the weight of the sabot.

In the front half of the propelling cage sabot, and particularly at least in the rear region of the conical tip 18 of the projectile body which is in contact with the inner conical surface of the hood portion 20, the longitudinal grooves 25 have only a slight remaining wall thickness 26 which is sufficiently small that crack formation along the bottoms of the grooves 25 is already initiated when the discarding sabot projectile 10 is introduced into the cartridge chamber of a weapon in a rapid succession. The wall thickness 26 is, for example, 0.15 to 0.5 mm, preferably about 0.3 mm (shown in the upper left half of the drawing), while the minimum wall thickness 28 of the propelling cage segments in this region is about 3 to 6 mm (shown in the upper right half of the drawing).

In the tip region of the propelling cage sabot hood 20, the longitudinal grooves 25 extend over the flat, disc-shaped tip 30 of the propelling cage or hood portion 20 and intersect at a right angle if the propelling cage is subdivided, for example, into four identical propelling cage segments, i.e., by means of four grooves 25. Beginning approximately at half the length of the conical projectile tip 18, the inner surface of the hood is such that the propelling cage segments no longer lie against the conical surface of the projectile body 18, so that a cavity 32 is produced in the forward tip region of the propelling cage hood.

In the rear region 34 of projectile tip 18, wherein the inner surface of the propelling cage hood 20 lies closely against the outer surface of the projectile body 12, force lines, which are shown schematically by arrows 33, which extend toward the exterior when the discarding sabot projectile is inserted into a cartridge chamber. As a result, according to the invention, the first initiation of crack formation (partial bursting open in the longitudinal direction) takes place at the desired break location, i.e., along the bottoms of the longitudinal grooves 25, when the projectile 10 is loaded into the chamber of the weapon in rapid succession. During acceleration upon firing, this crack travels forward to the propelling cage tip 30 which breaks open immediately along the intersecting desired break lines as soon as the outer guidance from the gun barrel is no longer provided, i.e. when about one-half of the discarding sabot projectile 10 has come out of the muzzle, and releases projectile body 12 without disadvantageously interfering with it. Thus, this break-up work with respect to both time and forces is very advantageously moved from a location in front of the gun barrel (as in the known arrangements) into the gun barrel itself.

The invention now being fully described, it will be apparent to one of ordinary skill in the art that any changes and modifications can be made thereto without departing from the spirit or scope of the invention as set forth herein.

What is claimed:

1. In a subcaliber, spin stabilized, discarding sabot projectile including a projectile body, with a conically tapered tip, and a discardable sabot which completely encloses said projectile body and includes a base portion and a plastic hood portion connected to said base portion, and with said hood portion having an inner conical surface which contacts at least a portion of said conically tapered tip of said projectile body and being provided, on its circumferential surface, with a plurality of symmetrically disposed grooves which extend in the longitudinal direction of said projectile and form desired break locations along which said hood portion of said sabot tears open into a plurality of segments after firing from a weapon and after the projectile has left the weapon muzzle; the improvement wherein the plastic material of said hood portion of said sabot in the bottom of each of said longitudinal grooves, at least in the region of said conically tapered projectile tip, has a wall thickness which is sufficiently thin that a given crack formation causing a slight separation of said material at said desired break locations is already initiated when the discarding sabot projectile is introduced, in rapid succession, into a cartridge chamber of a weapon.

2. A discarding sabot projectile as defined in claim 1 wherein said wall thickness at said bottom of each of said grooves at the desired break locations is about 0.1 to 0.5 mm.

3. A discarding sabot projectile as defined in claim 2 wherein said wall thickness is about 0.3 mm.

4. A discarding sabot projectile as defined in claim 1 wherein each of said longitudinal grooves forming a desired break location extends along substantially the entire length of said hood portion.

5. A discarding sabot projectile as defined in claim 4 wherein said hood portion has a conically tapered tip.

6. A discarding sabot projectile as defined in claim 1 wherein said hood portion has a conically tapered tip.

7. In a spin stabilized subcaliber discarding sabot projectile comprising a sabot and a subcaliber projectile body completely enclosed by said sabot, said sabot including a plurality of grooves extending along its outer circumferential surface in the longitudinal direction of said discarding sabot projectile which act as predetermined separation locations for dividing said sabot into a plurality of segments after said discarding sabot projectile has been fired from a gun and left the gun muzzle, the improvement comprising:

means for initiating a predetermined crack formation in said predetermined separation locations when said discarding sabot projectile is introduced into a cartridge chamber of a gun, whereby said sabot is partially separated at said break locations before said discarding sabot projectile is fired.

8. A discarding sabot projectile as defined in claim 7, wherein said means for initiating crack formation includes a wall thickness of said sabot at the bottom of at least a portion of each of said grooves which is between 0.15 and 0.5 mm.

9. A discarding sabot projectile as defined in claim 8, wherein said wall thickness of said sabot at the bottom of at least said portion of each of said grooves is approximately 0.3 mm.

10. A discarding sabot projectile as defined in claim 8, wherein said sabot includes a base portion and a hood portion which is connected to said base portion, which covers said projectile body, which is provided with said longitudinal grooves, and which is composed of a plastic material.

11. A discarding sabot projectile as defined in claim 10 wherein: said projectile body has a conically tapered tip; said hood portion has an inner surface portion which is correspondingly tapered and contacts at least a portion of said tapered tip of said projectile body; and said wall thickness of between 0.15 and 0.5 mm is disposed at at least the portion of said hood which contacts said tapered tip of said projectile body.

12. A discarding sabot projectile as defined in claim 11 wherein: said hood portion of said sabot has a conically tapered tip; and said plurality of grooves extend along the entire length of said hood portion.

* * * * *